US008960959B2

(12) United States Patent
Chen et al.

(10) Patent No.: US 8,960,959 B2
(45) Date of Patent: Feb. 24, 2015

(54) HANDLE ASSEMBLY FOR A LUGGAGE

(71) Applicants: Lien-Ti Chen, Changhua (TW); Yao-Te Chang, Taipei (TW)

(72) Inventors: Lien-Ti Chen, Changhua (TW); Yao-Te Chang, Taipei (TW)

( * ) Notice: Subject to any disclaimer, the term of this patent is extended or adjusted under 35 U.S.C. 154(b) by 162 days.

(21) Appl. No.: 13/802,760

(22) Filed: Mar. 14, 2013

(65) Prior Publication Data

US 2014/0268784 A1 Sep. 18, 2014

(51) Int. Cl.

| | |
|---|---|
| ***F21V 33/00*** | (2006.01) |
| ***A45C 13/28*** | (2006.01) |
| ***A45C 13/26*** | (2006.01) |

(52) U.S. Cl.

CPC ..... *A45C 13/28* (2013.01); *A45C 13/262* (2013.01); *F21V 33/0004* (2013.01)

USPC ..... 362/249.07; 16/113.1

(58) Field of Classification Search

CPC .. F21V 33/0004; A45C 13/28; A45C 13/262; A45C 2013/267

USPC ..... 362/249.07; 16/113.1

See application file for complete search history.

(56) References Cited

U.S. PATENT DOCUMENTS 5,956,807 A * 9/1999 Kuo ..... 16/113.1
6,186,295 B1 * 2/2001 Lin et al. ..... 190/18 A

* cited by examiner

*Primary Examiner* — Vip Patel

(57) ABSTRACT

A handle assembly for a luggage includes a case and a handle assembly. The case has an assembling portion recessed on one side of a top portion of the case towered a bottom portion of the case. The handle assembly is assembled to the case. The handle assembly is a transparent or semi-transparent plastic tube. One end of the handle assembly is inserted into the assembling portion, so that the handle assembly is slidable relative to the case. The handle assembly has a handle grip assembled with another end thereof. When the handle assembly is retracted into the case, the handle grip is abutted against the case.

8 Claims, 11 Drawing Sheets

HANDLE ASSEMBLY FOR A LUGGAGE

BACKGROUND OF THE INVENTION

1. Field of the Invention

The present invention relates to a luggage, and more particularly to a handle assembly for a luggage with transparent or semi-transparent appearance.

2. Description of Related Art

It is necessary for travelers to bring and protect their personal items. Therefore, numerous of containing means are invented to receive the personal items. Among these containing means, luggage boxes are popular because they can be moved easily. A conventional luggage box comprises a box body, an adjustable handle and a plurality of wheels. The adjustable handle is assembled at a top side of the box body. The wheels are rotatably assembled at a bottom side of the box body.

Under this arrangement, the traveler puts the conventional luggage box on the ground and pulls the adjustable handler to move the conventional luggage box via the wheels.

However, the conventional luggage has some disadvantages as following. The adjustable handle of the conventional luggage box is made of metal, so that the adjustable handle is heavy. In addition, the metallic adjustable handle gets rust easily and dents easily while an impact is occurred on the adjustable handle.

The present invention has arisen to obviate/mitigate the disadvantages of the conventional luggage.

SUMMARY OF THE INVENTION

The main objective of the present invention is to provide an improved handle assembly for a luggage.

To achieve the objective, a handle assembly for a luggage comprises a case and a handle assembly, the case having an assembling portion recessed on one side of a top portion of the case towered a bottom portion of the case, the handle assembly assembled to the case, the handle assembly being a transparent or semi-transparent plastic tube, one end of the handle assembly inserted into the assembling portion, the handle assembly being slidable relative to the case, the handle assembly having a handle grip assembled with another end thereof. When the handle assembly is retracted into the case, the handle grip is abutted against the case. Wherein the handle assembly has an outer rod and an inner rod; the inner rod is inserted into the outer rod and the inner rod is slidable relative to the outer rod; the outer rod has a plurality of through holes opened at one lateral side thereof; each two adjacent through holes are separated by a distance; the inner rod has an elastic post disposed at a bottom end thereof; the elastic post is compressed by an inner periphery of the outer rod as the inner rod is drawn relative to the outer rod and then the elastic post is engaged with the corresponding through hole via a recovery force of the elastic post, so that the inner rod is positioned relative to the outer rod; an electric control device is mounted in the inner rod, the outer rod and the handle grip; the electric control device has a plurality of light emitting elements, a circuit module and a control button; the circuit module is mounted in the handle grip; the circuit module is connected with the light emitting elements and the control button electrically; the light emitting elements are disposed in the inner rod, the outer rod and the handle grip, so that the light emitting elements are lighted outwardly; the control button is assembled with the handle grip and one end of the button is exposed from the handle grip; the circuit module has a flickering program which controls the lighting order of the light emitting elements, a lightness control program which controls the lightness of the light emitting elements, and a lighting color control program which controls the lighting color of the light emitting elements; the handle grip has a lighting member assembled therein; the handle grip has an assembling hole corresponding to the lighting member; one end of the lighting member is exposed from the assembling hole, so that the light of the lighting member is lighted outwardly; another end of the lighting member is disposed in the handle grip and is connected with the circuit module electrically; the circuit module has a switching program for switching the lighting member; the handle grip has a switching member disposed on one side of the handle grip which is opposite to the assembling portion; the switching member is connected with the circuit module electrically so as to turn the light emitting elements on or off; the handle assembly has a pattering portion disposed on an outer periphery thereof.

The present invention will become more obvious from the following description when taken in connection with the accompanying drawings which show, for purposes of illustration only, a preferred embodiment in accordance with the present invention.

DETAILED DESCRIPTION OF THE INVENTION

Figure 1:
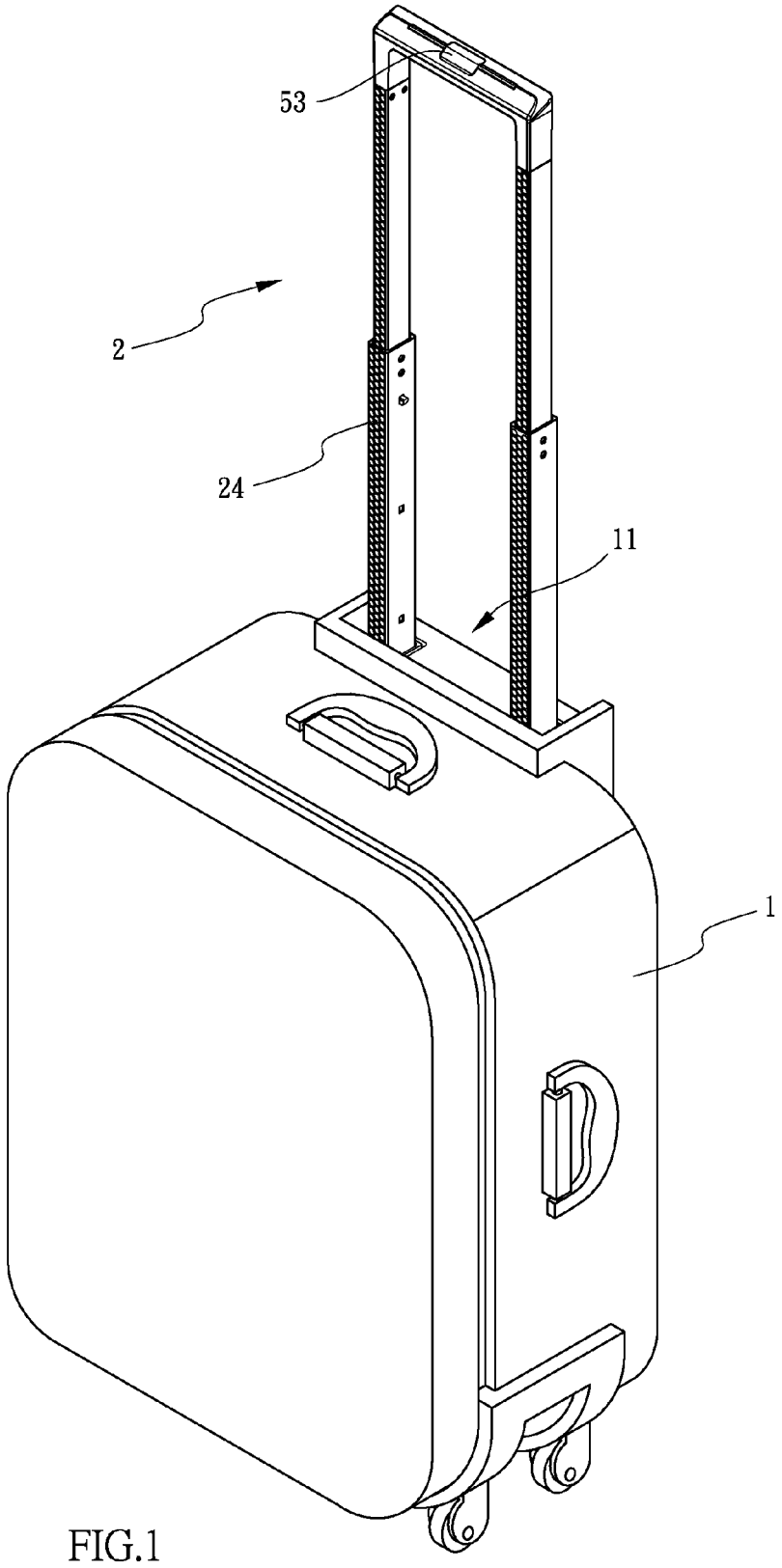
FIG. 1 is a perspective view of a handle assembly for a luggage of the present invention.
Figure 2:
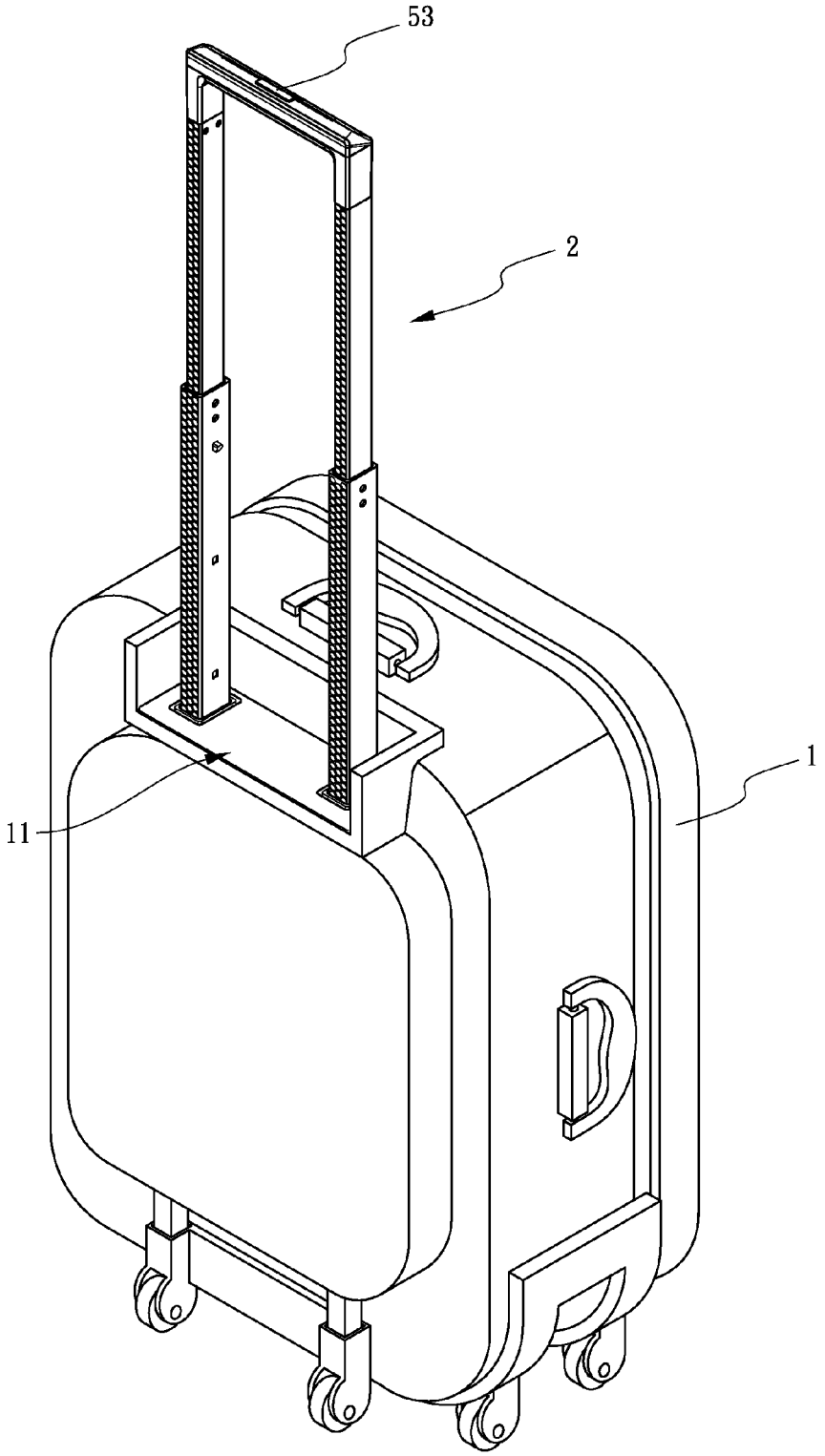
FIG. 2 is another perspective view of the handle assembly for a luggage of the present invention.

Referring to FIGS. 1-2, a handle assembly for a luggage in accordance with the present invention comprises a case 1 and a handle assembly 2. The case 1 has an assembling portion 11 recessed on one side of a top portion of the case 1 towered a bottom portion of the case 1. The handle assembly 2 is assembled to the case 1. The handle assembly 2 is a transparent or semi-transparent plastic tube. One end of the handle assembly 2 is inserted into the assembling portion 11, so that the handle assembly 2 is slidable relative to the case 1. The handle assembly 2 has a handle grip 3 assembled with another end thereof. When the handle assembly 2 is retracted into the case 1, the handle grip 3 is abutted against the case 1 so as to restrict the movement of the handle assembly 2. The handle grip 3 is transparent or semi-transparent plastic tube.

The handle assembly 2 further has an outer rod 21 and an inner rod 22. The inner rod 22 is inserted into the outer rod 21 and the inner rod 22 is slidable relative to the outer rod 21. The outer rod 21 has a plurality of through holes 211 opened at one lateral side thereof. Each two adjacent through holes 211 are separated by a distance. The inner rod 22 has an elastic post 4 disposed at a bottom end thereof. The elastic post 4 is compressed by an inner periphery of the outer rod 21 as the inner rod 22 is drawn relative to the outer rod 21. The elastic post 4 is engaged with the corresponding through hole 211 via a recovery force of the elastic post 4, so that the inner rod 22 is positioned relative to the outer rod 21. A spring 41 is disposed at a terminal end of the elastic post 4. One end of the spring 41 is abutted against an inner periphery of the inner rod 22 and another end of the spring 41 is abutted against the terminal end of the elastic post 4, so that the elastic post 4 is ejected spontaneously and passes through the corresponding through hole 211 via the recovery force of the spring 41 as shown in FIG. 3.

Figure 6:
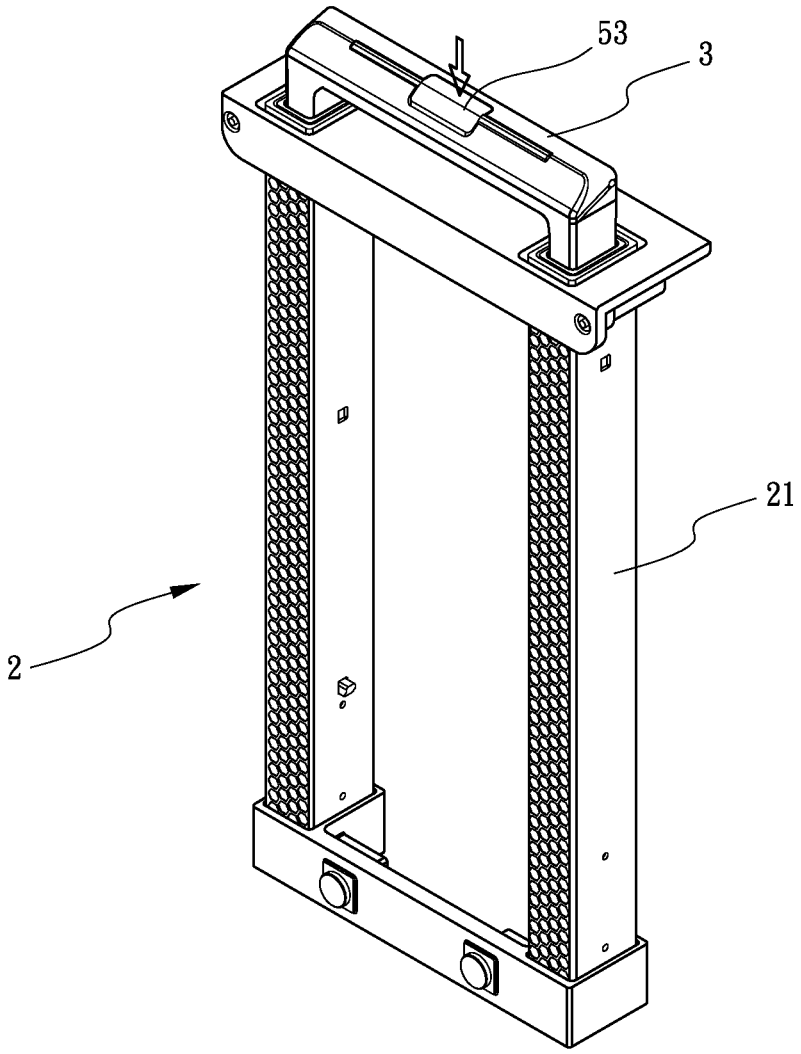
FIG. 6 is a perspective view of the handle assembly of the present invention, wherein the handle assembly is not elongated.
Figure 7:
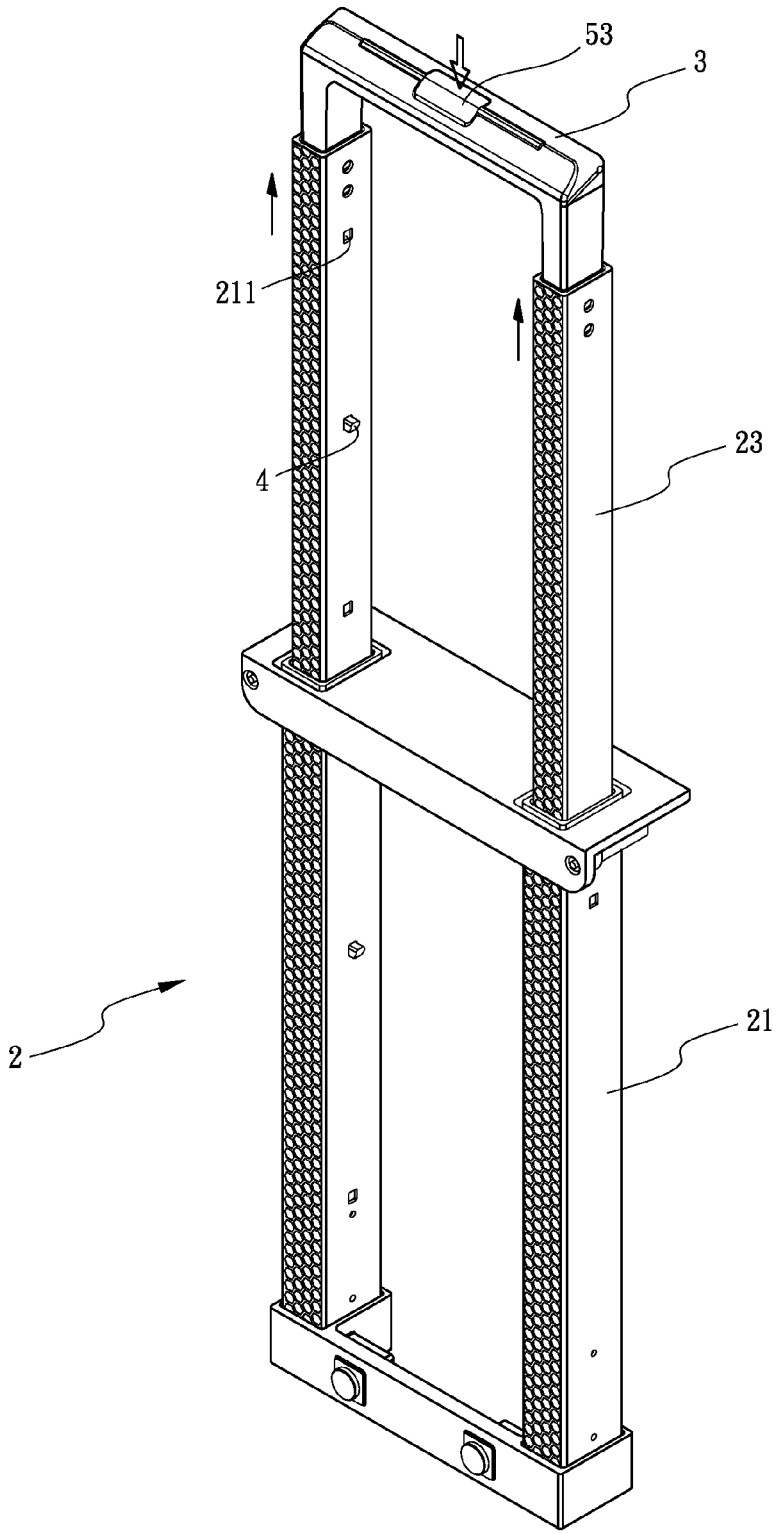
FIG. 7 is a perspective view of the handle assembly of the present invention, wherein the handle assembly is elongated.
Figure 8:
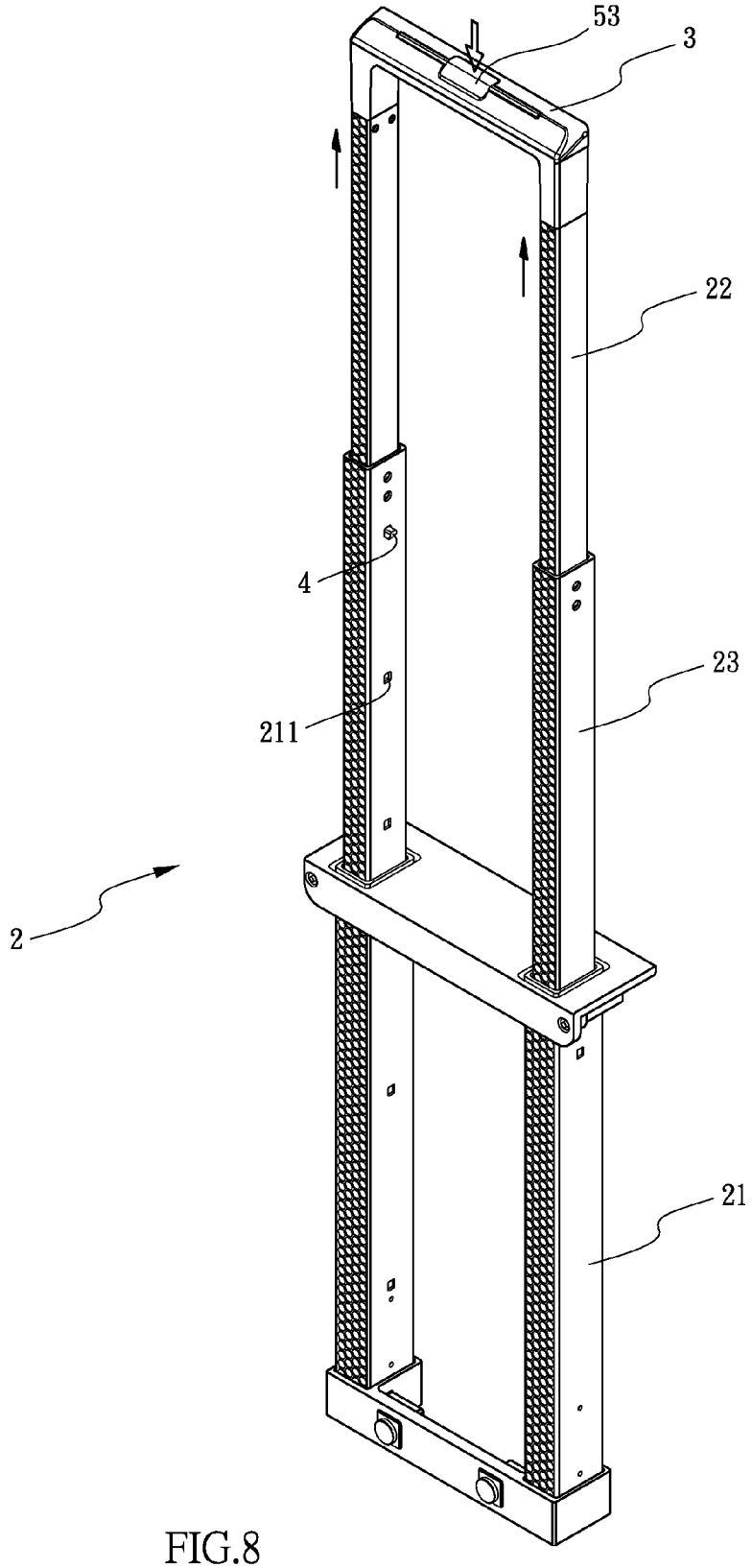
FIG. 8 is a perspective view of the handle assembly of the present invention, wherein the handle assembly is elongated completely.
Figure 10:
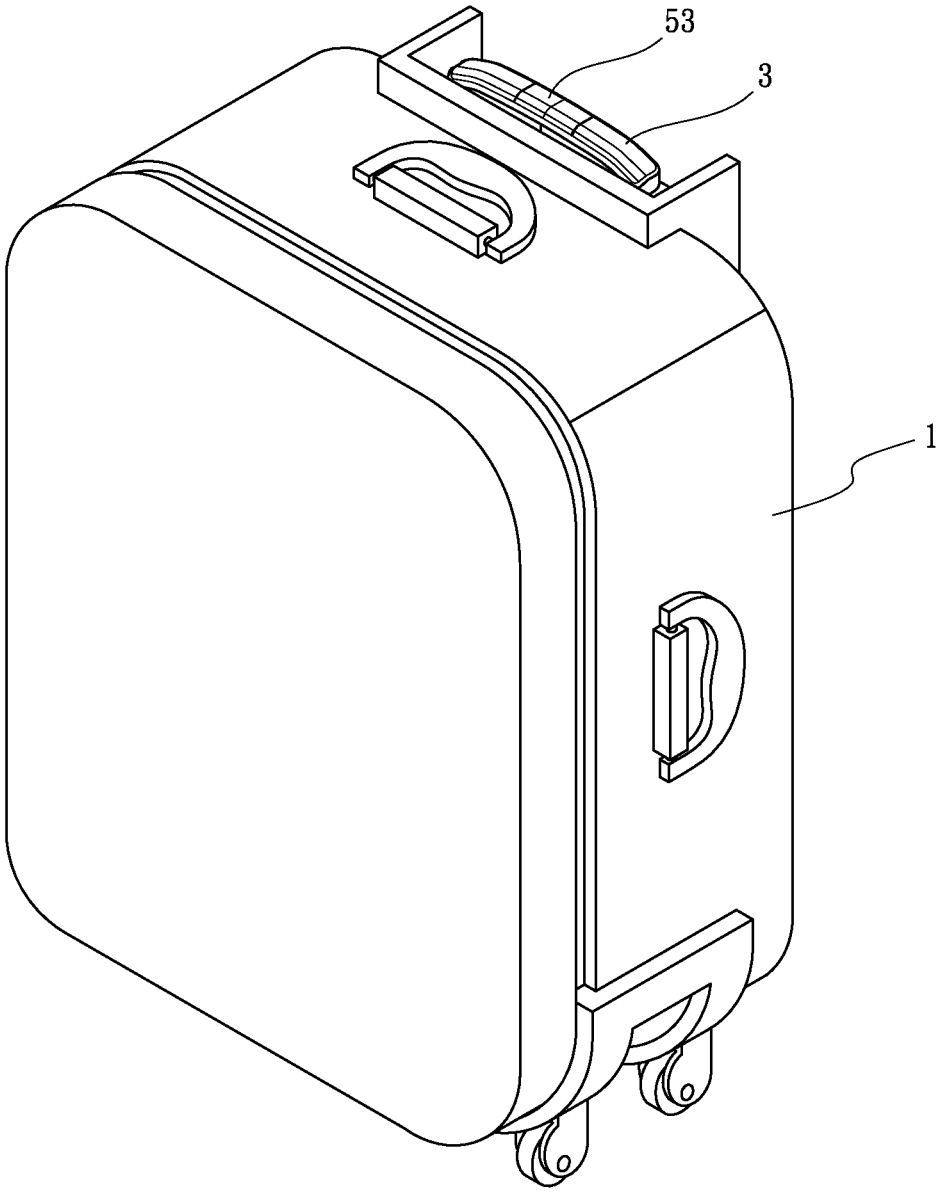
FIG. 10 is a perspective view of another embodiment of the handle assembly for a luggage of the present invention.
Figure 11:
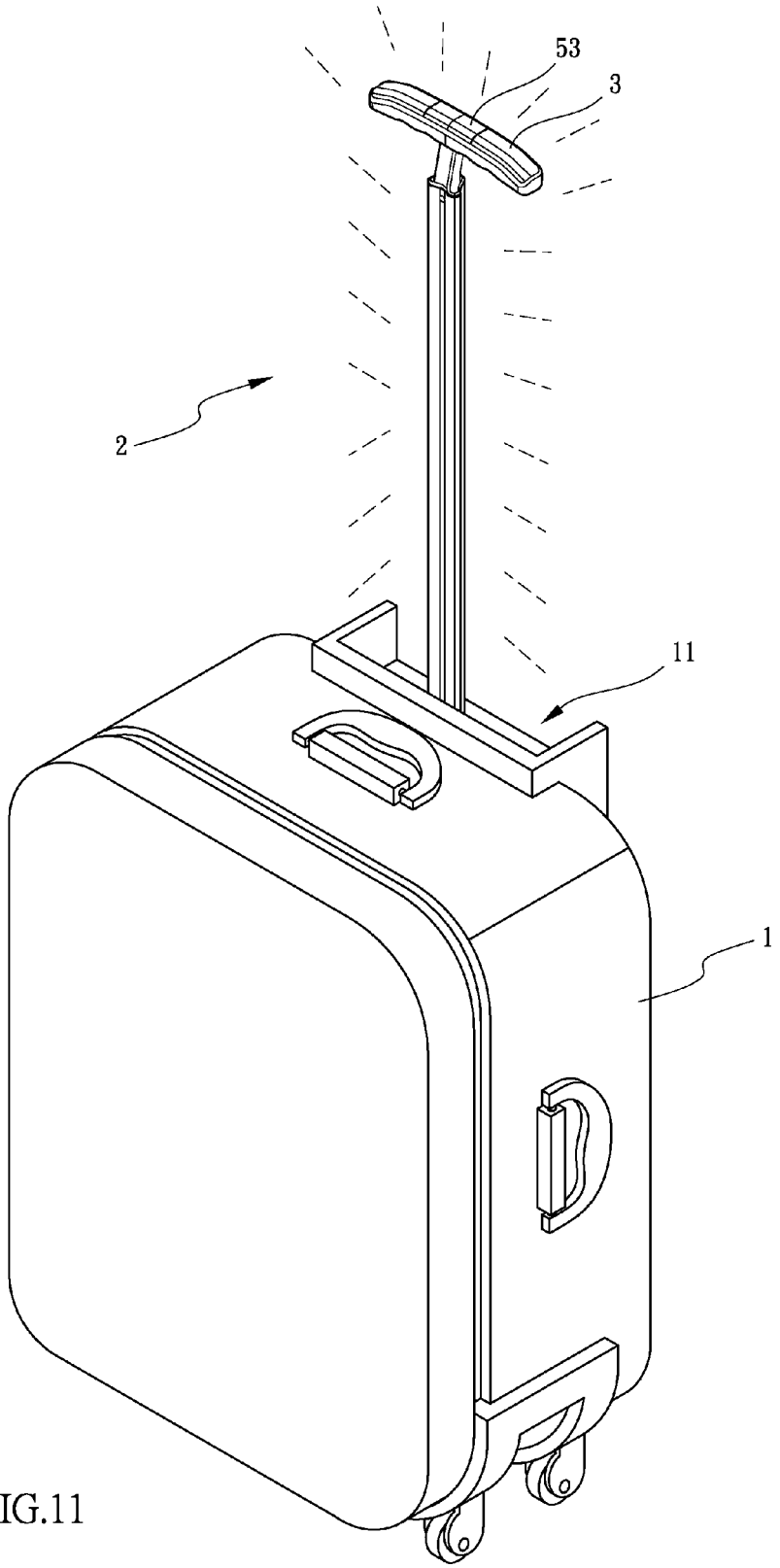
FIG. 11 is a schematic view of another embodiment of the present invention for showing the handle assembly is lighted.

The handle assembly 2 has two types. One type of the handle assembly 2 has one inner rod 22, one outer rod 21 and one handle grip 3. The outer rod 21 is inserted into the assembling portion 11 of the case 1. The inner rod 22 is inserted into the outer rod 21 slidably, so that the inner rod 22 could be drawn relative the outer rod 21 as shown in FIGS. 10-11. Another type of the handle assembly 3 has two inner rods 22, two outer rods 21 and one handle grip 3. The handle assembly 3 further has two middle rods 23 assembled between the two inner rods 22 and the two outer rods 21 respectively. Each middle rod 23 is inserted into each outer rod 21. Each inner rod 22 is inserted into each middle rod 23. Each middle rod 23 and each outer rod 21 both have a plurality of through holes 211 opened at one lateral side thereof. The through holes 211 of each middle rod 23 correspond to the through holes 211 of the corresponding outer rod 21. Each middle rod 23 and each inner rod 22 both have an elastic post 4 defined at a bottom end thereof. The length of handle assembly 2 could be extended via the middle rods 23 so as to be adjusted for different users with various heights as shown in FIGS. 6-8. (The extending length of the handle assembly 2 is not limited in the present invention.)

Figure 3:
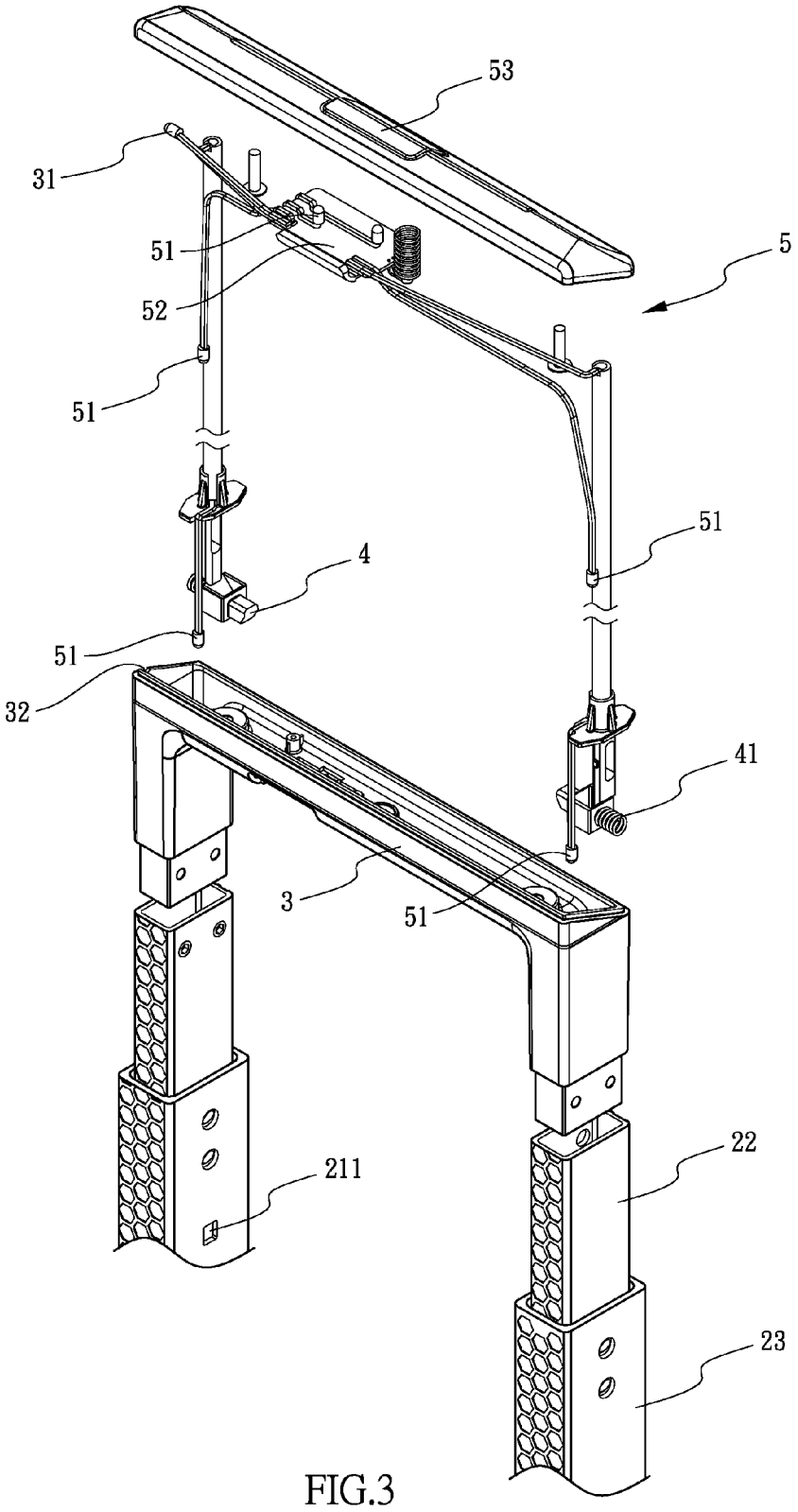
FIG. 3 is an exploded view of a handle assembly of the present invention.

Referring to FIG. 3, an electric control device 5 is mounted in the inner rod 22, the outer rod 21 and the handle grip 3. The electric control device 5 has a plurality of light emitting elements 51, a circuit module 52 and a control button 53. The light emitting elements 51 are disposed in the inner rod 22, the outer rod 21 and the handle grip 3, wherein the light emitting elements 51 are lighted outwardly through the inner rod 22, the outer rod 21 and the handle grip 3. The circuit module 52 is mounted in the handle grip 3. The control button 53 is assembled with the handle grip 3 and one end of the button 53 is exposed from the handle grip 3. The control button 53 is connected with the circuit module 52 electrically. Each light emitting element 51 is connected with the circuit module 52 electrically. When the user presses the control button 53, the circuit module 52 is started and the light emitting elements 51 are lighted. In addition, the inner rod 22, the outer rod 21, the middle rod 23 and the handle grip 3 of the handle assembly 2 are transparent or semi-transparent, so that the light of the light emitting elements 51 passes through the handle assembly 2; therefore, the handle assembly 2 is lighted so as to light up the surrounding environment.

Figure 5:
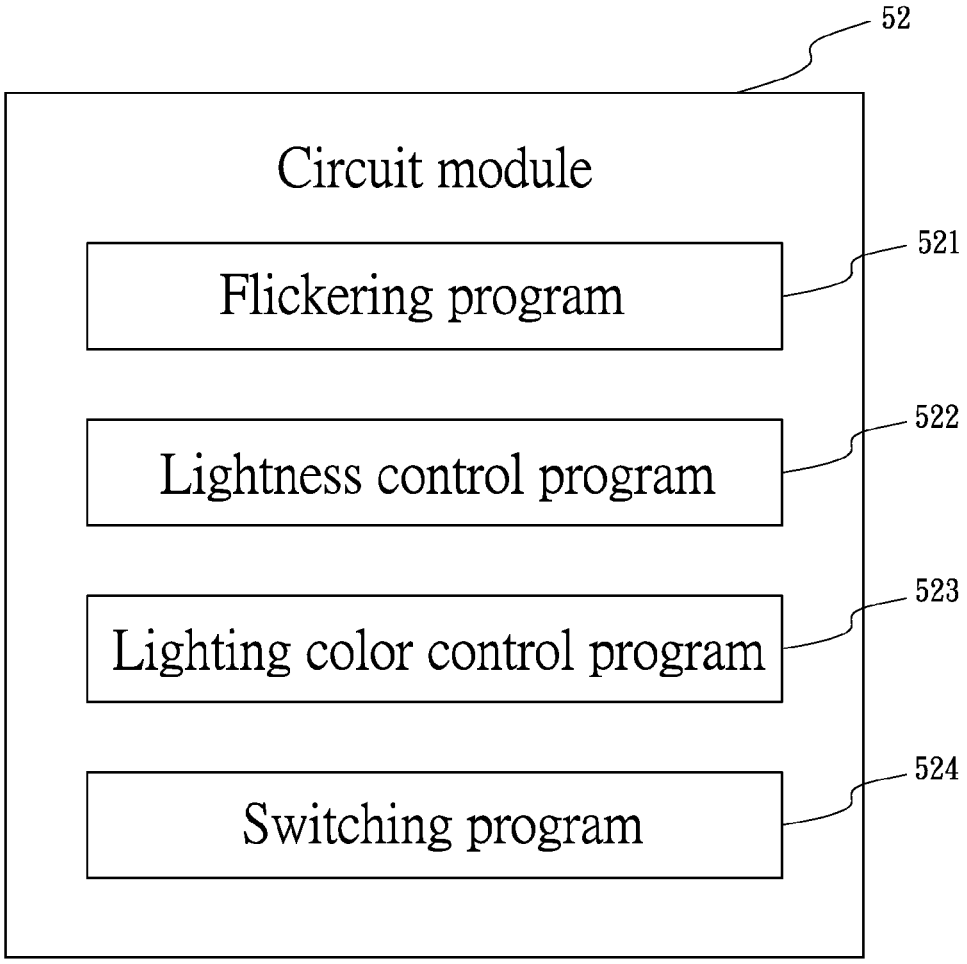
FIG. 5 is a block chart for showing a circuit module of the present invention.
Figure 9:
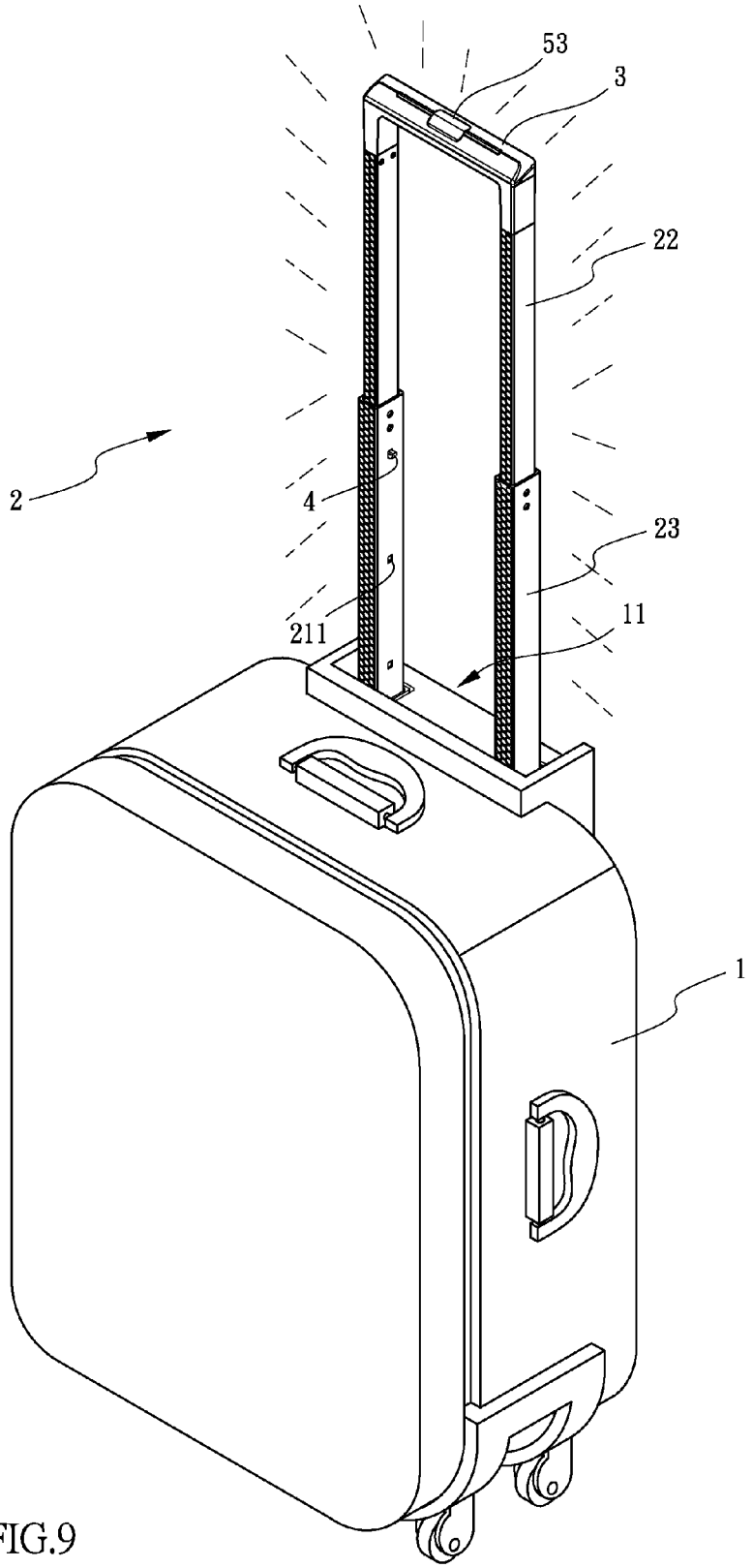
FIG. 9 is a schematic view of the handle assembly for a luggage of the present invention for showing the handle assembly is lighted.

Referring to FIG. 5 and FIG. 9, the light emitting elements 51 have varied lighting modes. The circuit module 52 has a flickering program 521 which controls the lighting order of the light emitting elements 51, a lightness control program 522 which controls the lightness of the light emitting elements 51, and a lighting color control program 523 which controls the lighting color of the light emitting elements 51. The user could press the control button 53 to switch different program of the circuit module 52 so as to control the operating status of the light emitting elements 51. (The number of the program of the circuit module 52 is not limited in the present invention.)

Referring to FIG. 3 and FIG. 5, the handle grip 3 further has a lighting member 31 assembled therein. The handle grip 3 has an assembling hole 32 corresponding to the lighting member 31. The lighting member 31 is assembled to the assembling hole 32. One end of the lighting member 31 is exposed from the assembling hole 32, so that the light of the lighting member 31 is lighted outwardly. Another end of the lighting member 31 is disposed in the handle grip 3 and is connected with the circuit module 52 electrically. In order to control the lighting member 31, the circuit module 52 further has a switching program 524 for switching the lighting member 31. The user could press the control button 53 to switch the lighting member 31 on so as to light up the surrounding environment.

Figure 4:
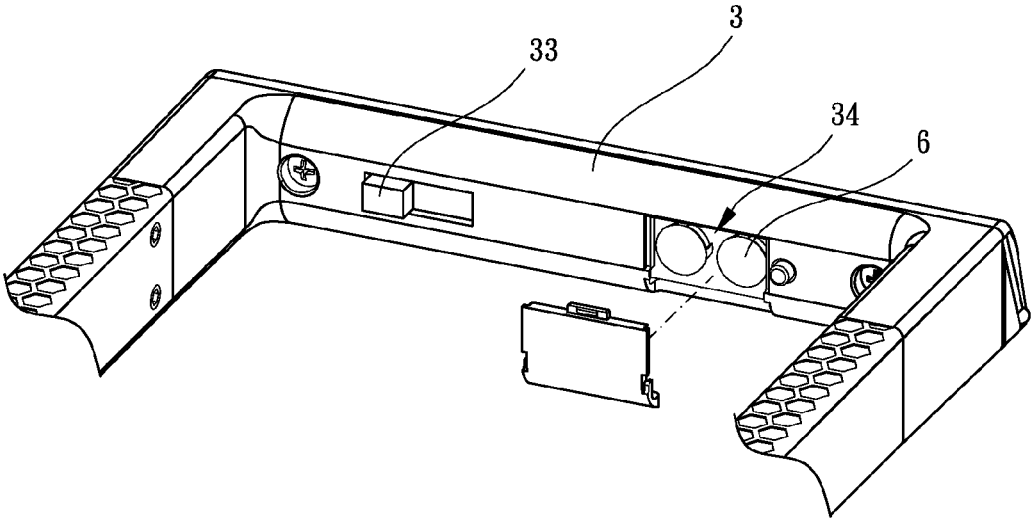
FIG. 4 is a schematic view of a bottom side of a handle grip of the present invention.

Referring to FIG. 4, the handle grip 3 has a switching member 33 for controlling the light emitting elements 51, so that the light emitting elements 51 could be operated manually; therefore, the light emitting elements 51 could be turned off if unnecessary so as to save the electricity and to extend the life time of the light emitting elements 51. The switching member 33 is disposed on one side of the handle grip 3 with is opposite to the assembling portion 11 and on the opposite side of the control button 53. The switching member 33 is connected with the circuit module 52 electrically so as to turn the light emitting elements 51 on or off. The handle grip 3 has a battery chamber 34 defined at one side thereof. The battery chamber 34 is adjacent to the switching member 33. The battery chamber 34 has at least one power element 6 so as to provide a power source for the handle assembly 2. (The power element 6 of the present invention is alkaline cell, mercury cell or Lithium battery; however, the power element is not limited in the present invention.)

The advantages of the present invention are described as following:

1. The user could draw a luggage conveniently because of the handle assembly 2.

2. The handle assembly 2 is transparent or semi-transparent, so that the light could pass through the handle assembly 2.

3. When the user presses the control button 53 to control the circuit module 52, the handle assembly 2 could change the lighting color, the flickering mode, and the lightness of the handle assembly 2. Therefore, the handle assembly 2 is bright in the dark and the user could find objects in the luggage conveniently.

4. The lighting member 31 of the handle grip 3 could light up the surrounding environment in the dark.

The handle assembly 2 has a pattering portion 24 disposed on an outer periphery of the handle assembly 2. Therefore, the appearance of the handle assembly 2 is characteristic. Besides, the pattering portion 24 also increases the non-slip effect as shown in FIGS. 1-2.

Although the invention has been explained in relations to its preferred embodiment, it is to be understood that many other possible modifications and variations can be made without departing from the spirit and scope of the invention as hereinafter claimed.

What is claimed is:

1. A handle assembly for a luggage comprising:

a case and a handle assembly;

the case having an assembling portion recessed on one side of a top portion of the case towered a bottom portion of the case; and the handle assembly assembled to the case, the handle assembly being a transparent or semi-transparent plastic tube, one end of the handle assembly inserted into the assembling portion, the handle assembly being slidable relative to the case, the handle assembly having a handle grip assembled with another end thereof;

wherein, when the handle assembly is retracted into the case, the handle grip is abutted against the case so as to restrict the handle assembly.

2. The handle assembly for a luggage as claimed in claim 1, wherein the handle assembly has an outer rod and an inner rod; the inner rod is inserted into the outer rod and the inner rod is slidable relative to the outer rod; the outer rod has a plurality of through holes opened at one lateral side thereof; each two adjacent through holes are separated by a distance; the inner rod has an elastic post disposed at a bottom end thereof; the elastic post is compressed by an inner periphery of the outer rod as the inner rod is drawn relative to the outer rod and then the elastic post is engaged with the corresponding through hole via a recovery force of the elastic post, so that the inner rod is positioned relative to the outer rod.

3. The handle assembly for a luggage as claimed in claim 2, wherein an electric control device is mounted in the inner rod, the outer rod and the handle grip; the electric control device has a plurality of light emitting elements, a circuit module and a control button; the circuit module is mounted in the handle grip; the circuit module is connected with the light emitting elements and the control button electrically; the light emitting elements are disposed in the inner rod, the outer rod and the handle grip, so that the light emitting elements are lighted outwardly; the control button is assembled with the handle grip and one end of the button is exposed from the handle grip.

4. The handle assembly for a luggage as claimed in claim 3, wherein the circuit module has a flickering program which controls the lighting order of the light emitting elements, a lightness control program which controls the lightness of the light emitting elements, and a lighting color control program which controls the lighting color of the light emitting elements.

5. The handle assembly for a luggage as claimed in claim 4, wherein the handle grip has a lighting member assembled therein; the handle grip has an assembling hole corresponding to the lighting member; one end of the lighting member is exposed from the assembling hole, so that the light of the lighting member is lighted outwardly; another end of the lighting member is disposed in the handle grip and is connected with the circuit module electrically.

6. The handle assembly for a luggage as claimed in claim 5, wherein the circuit module has a switching program for switching the lighting member.

7. The handle assembly for a luggage as claimed in claim 3, wherein the handle grip has a switching member disposed on one side of the handle grip which is opposite to the assembling portion; the switching member is connected with the circuit module electrically so as to turn the light emitting elements on or off.

8. The handle assembly for a luggage as claimed in claim 2, wherein the handle assembly has a pattering portion disposed on an outer periphery thereof.

* * * * *